US009732432B2

(12) United States Patent
Hirsi et al.

(10) Patent No.: US 9,732,432 B2
(45) Date of Patent: Aug. 15, 2017

(54) METHOD AND ARRANGEMENT FOR COLLECTING AND REMOVAL OF ACID MIST FROM AN ELECTROLYTIC CELL

(71) Applicant: OUTOTEC (FINLAND) OY, Espoo (FI)

(72) Inventors: Tuomas Hirsi, Helsinki (FI); Timo Hautaniemi, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/304,986

(22) PCT Filed: Apr. 22, 2015

(86) PCT No.: PCT/FI2015/050274
§ 371 (c)(1),
(2) Date: Oct. 18, 2016

(87) PCT Pub. No.: WO2015/162336
PCT Pub. Date: Oct. 29, 2015

(65) Prior Publication Data

US 2017/0175279 A1 Jun. 22, 2017

(30) Foreign Application Priority Data

Apr. 23, 2014 (FI) ..... 20145376

(51) Int. Cl.
*C25C 7/06* (2006.01)

(52) U.S. Cl.
CPC ..... *C25C 7/06* (2013.01)

(58) Field of Classification Search
CPC ..... C25C 7/06
See application file for complete search history.

(56) References Cited

U.S. PATENT DOCUMENTS

| | | | |
|---|---|---|---|
| 5,855,749 | A | 1/1999 | Kohut et al. |
| 2003/0019743 | A1 | 1/2003 | Miura et al. |
| 2011/0108414 | A1 | 5/2011 | Penna Wittig et al. |

FOREIGN PATENT DOCUMENTS

| | | | |
|---|---|---|---|
| CN | 201834958 | U | 5/2011 |
| CN | 202968718 | U | 6/2013 |

(Continued)

OTHER PUBLICATIONS

International Search Report issued by the European Patent Office in relation to International Application No. PCT/FI2015/050274 dated Jul. 2, 2015 (4 pages).

(Continued)

*Primary Examiner* — Ciel Thomas
(74) *Attorney, Agent, or Firm* — Robert P. Michal, Esq.; Carter, DeLuca, Farrell & Schmidt, LLP

(57) ABSTRACT

A method and an arrangement for collecting and removal of acid mist from an electrolytic cell. The arrangement includes a cover for covering an open top of a container of the electrolytic cell so that a space is formed between a surface of electrolyte contained in the container and the cover, a decontamination system provided with an acid mist suction channel terminating in an upwards facing inlet opening in the space, and a cleaning arrangement for spraying the upwards facing inlet opening with washing fluid. The cleaning arrangement has a fluid nozzle. The fluid nozzle is in the acid mist suction channel. The fluid nozzle is arranged to spray washing fluid at least downwards into the acid mist suction channel.

18 Claims, 2 Drawing Sheets

(56) References Cited

FOREIGN PATENT DOCUMENTS

| | | | |
|---|---|---|---|
| CN | 103436916 | A | 12/2013 |
| CN | 203440472 | U | 2/2014 |
| EP | 1845175 | A1 | 10/2007 |
| WO | WO-9412696 | A1 | 6/1994 |

OTHER PUBLICATIONS

Search Report issued by the Finnish Patent and Registration Office in relation to Finnish Patent Application No. 20145376 dated Nov. 5, 2014 (1 page).

Written Opinion of the International Searching Authority issued by the European Patent Office in relation to International Application No. PCT/FI2015/050274 dated Jul. 2, 2015 (5 pages).

METHOD AND ARRANGEMENT FOR COLLECTING AND REMOVAL OF ACID MIST FROM AN ELECTROLYTIC CELL

CROSS-REFERENCE TO RELATED APPLICATIONS

This application is a National Phase Entry under 35 USC §371 of PCT Patent Application Serial No. PCT/FI2015/050274 filed Apr. 22, 2015, which claims the benefit under 35 USC §119(e) to Finnish Patent Application No. 20145376, filed Apr. 23, 2014, the disclosure of each of these applications are expressly incorporated herein by reference in their entireties.

FIELD OF THE INVENTION

The invention relates to a method for collecting and removal of acid mist from an electrolytic cell in a metal electrowinning process or in a metal electrorefining process, where an electric current is passed between a plurality of electrodes, from anodes to cathodes alternately arranged and submerged in electrolyte contained in a container having an open top, wherein the method comprising covering the open top of the container with a cover so that a space is formed between a surface of the electrolyte contained in the container and the cover, providing a decontamination system provided with an acid mist suction channel terminating in an upwards facing inlet opening in the space between the surface of the electrolyte contained in the container and the cover, and provided with suction means for sucking acid mist from the space between the surface of the electrolyte contained in the container and the cover, sucking acid mist from the space between the surface of the electrolyte contained in the container and the cover by means of the suction means of the decontamination system, providing a cleaning arrangement for spraying the upwards facing inlet opening of the acid mist suction channel with washing fluid to prevent the upwards facing inlet opening of the acid mist suction channel from being blocked, and spraying the upwards facing inlet opening of the acid mist suction channel with washing fluid by means of the cleaning arrangement to prevent the upwards facing inlet opening of the acid mist suction channel from being blocked, as defined in the preamble of independent claim 1.

The invention also relates to an arrangement for collecting and removal of acid mist from an electrolytic cell in a metal electrowinning process or in a metal electrorefining process, where an electric current is passed between a plurality of electrodes, from anodes to cathodes alternately arranged and submerged in electrolyte contained in a container having an open top, wherein the arrangement comprising a cover for covering the open top of the container so that a space is formed between a surface of the electrolyte contained in the container and the cover, a decontamination system provided with an acid mist suction channel terminating in an upwards facing inlet opening in the space between the surface of the electrolyte contained in the container and the cover, and provided with suction means for sucking acid mist from the space between the surface of the electrolyte contained in the container and the cover, and a cleaning arrangement for spraying the upwards facing inlet opening of the acid mist suction channel with washing fluid to prevent the upwards facing inlet opening of the acid mist suction channel from being blocked, as defined in the preamble of independent claim 10.

BACKGROUND INFORMATION

Blocking of the vertical acid mist suction channel due to scaling such as copper sulfate scaling at the upwards facing inlet opening is a problem. This can hinder the acid mist flow, which results in increased acid mist in the tankhouse space atmosphere causing increased worker health risk and also equipment corrosion.

Various methods and arrangements for collecting and removal of acid mist from an electrolytic cell in metal electrowinning process or a metal electrorefining process are known in the art.

Publication US 2011/0108414 presents a multi-element cover system for controlling acid mist in metal electrowinning or electrorefining cells is made of an electrolyte resistant material and is applied above the surface of the electrolyte and below the electrical connections of the electrodes in order to provide a continuous and substantially airtight seal above the electrolyte. The cover system comprises a plurality of flexible longitudinally concave caps arranged between the cathode and the anode that help to shift the acid mist towards the sides of the cell using the same energy that disengages it from the electrolyte; lids between the electrodes and the wall of the corresponding end of the cell; and lateral enclosures located at both sides of the cell in the space between the electrodes and the lateral walls of the cell, the lateral enclosures having at least a top side, end walls at each end and an inner side projecting towards the electrolyte, thus forming a chamber inside the lateral enclosure, with the lower side of the enclosure or the electrolyte itself acting as the bottom boundary of the chamber, the chamber being connected to external acid mist suction means and its inner side provided with bores above the electrolyte level so as to in this fashion, in collaboration with the flexible caps, uniformly suck and remove the acid mist confined under the caps throughout the entire cell with a gentle suction and without the risk of crystal formation due to oversaturation of the droplets contained in the mist.

SUMMARY

An object of the invention is to provide a method and an arrangement for collecting and removal of acid mist from an electrolytic cell in a metal electrowinning process or in a metal electrorefining process, which has an effective arrangement for preventing blocking of the vertical acid mist suction channel.

The method of the invention is characterized by the definitions of independent claim 1.

Preferred embodiments of the method are defined in the dependent claims 2 to 9.

The arrangement of the invention is correspondingly characterized by the definitions of independent claim 10.

Preferred embodiments of the arrangement are defined in the dependent claims 11 to 18.

The invention is based on arranging the cleaning arrangement for spraying the upwards facing inlet opening of the acid mist suction channel at least partly in the acid mist suction channel. The cleaning arrangement has a fluid nozzle and a pipe for feeding washing fluid to the fluid nozzle. The pipe and the fluid nozzle are arranged so that the pipe is at least partly located in the acid mist suction channel and so that the fluid nozzle is located at the upwards facing inlet opening of the acid mist suction channel. Washing fluid is sprayed at least downwards into the acid mist suction channel by means of the fluid nozzle of the cleaning arrangement.

An advantage with the method and the arrangement is that this requires no openings or holes in the cover covering the open top of the container. Additionally, when the cover is lowered, only a small part of the fluid nozzle will be visible, because the fluid nozzle is protected by the acid mist suction channel, and this reduces considerably the risk that the cover hits the fluid nozzle and/or the piping, and thus the fluid nozzle will keep its position better.

BRIEF DESCRIPTION OF THE DRAWINGS

The following invention will described in more detail by referring to the figures, wherein.

DETAILED DESCRIPTION

Figure 1:
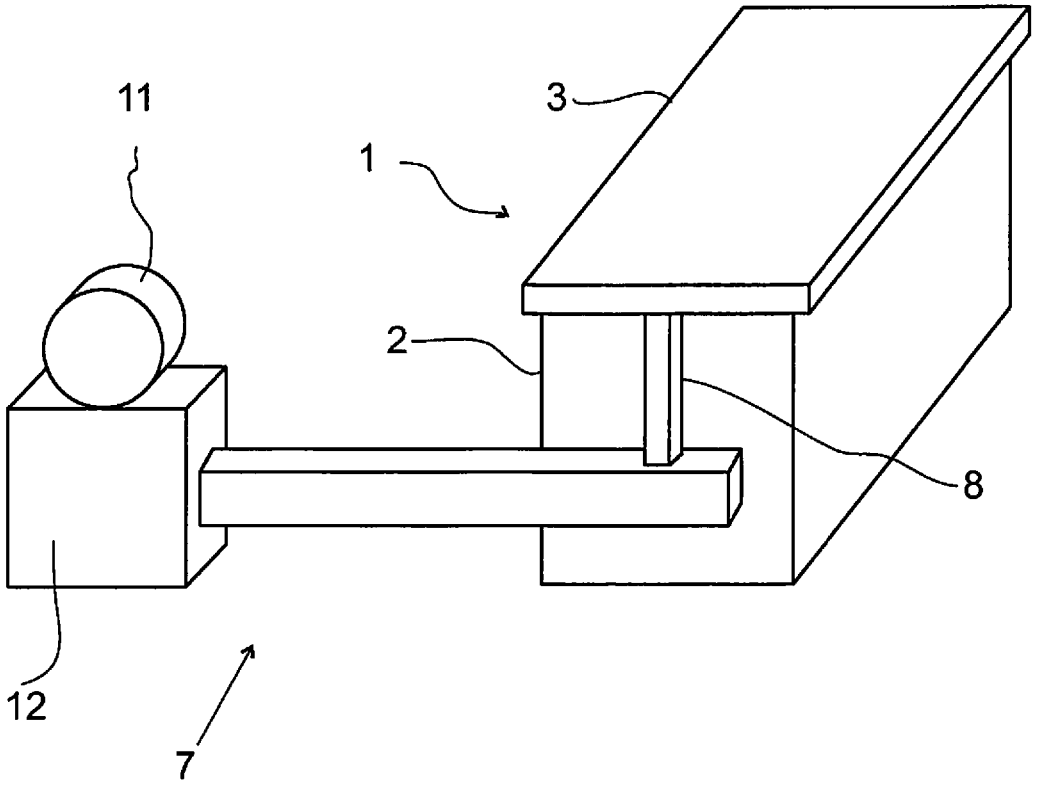
FIG. 1 is a schematic illustration of an arrangement for collecting and removal of acid mist from an electrolytic cell.
Figure 2:
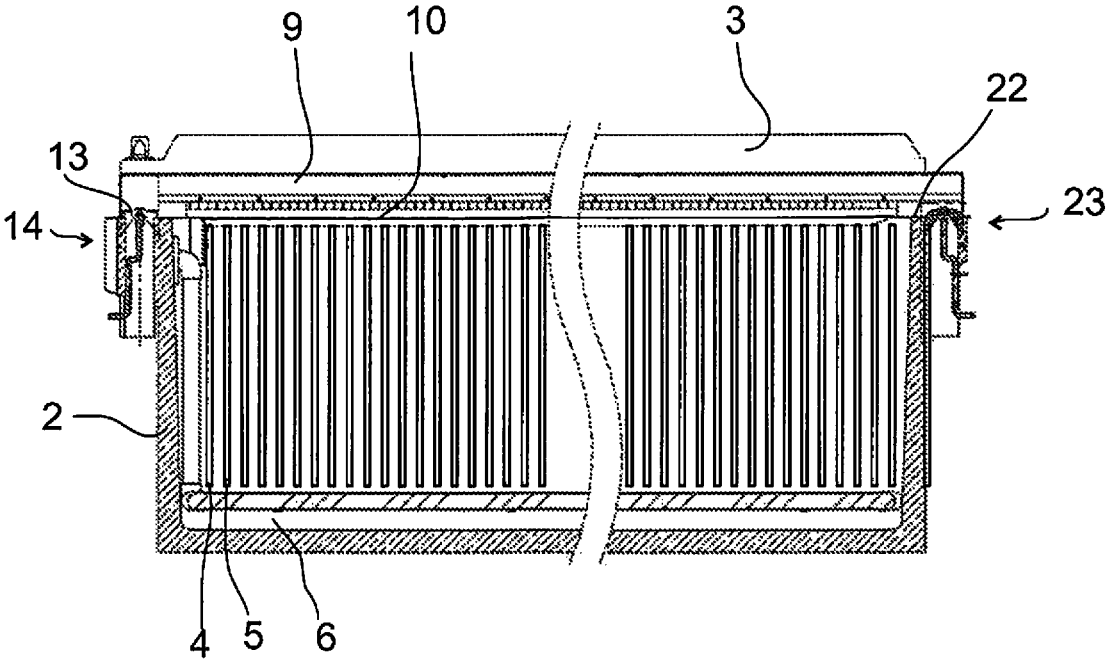
FIG. 2 is a cross-sectional view of an electrolytic cell having an arrangement for collecting and removal of acid mist from an electrolytic cell.
Figure 3:
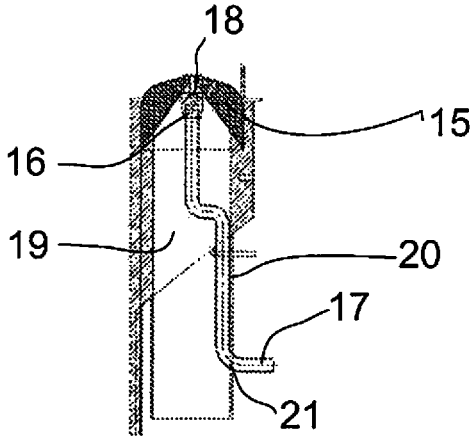
FIG. 3 is a cross-sectional view of the electrolytic cell shown in FIG. 3.

The invention relates to a method and to an arrangement for collecting and removal of acid mist (not shown in the drawings) from an electrolytic cell 1 in a metal electrowinning process or in a metal electrorefining process, where an electric current is passed between a plurality of electrodes, from anodes 4 to cathodes 5 alternately arranged and submerged in electrolyte 6 contained in a container 2 having an open top (not marked with a reference numeral). The metal may be copper.

First the method and some preferred embodiments and variants of the method will be described in greater detail.

The method comprises covering the open top of the container 2 with a cover 3 so that a space 9 is formed between a surface 10 of the electrolyte 6 contained in the container 2 and the cover 3.

The method comprises providing a decontamination system 7 provided with an acid mist suction channel 8 terminating in an upwards facing inlet opening 13 in the space 9 between the surface 10 of the electrolyte 6 contained in the container 2 and the cover 3, and provided with suction means 11 for sucking acid mist from the space 9 between the surface 10 of the electrolyte 6 contained in the container 2 and the cover 3. The decontamination system 7 provided in the method may have a scrubber 12 for scrubbing acid mist originating from at least one electrolytic cell 1. Several electrolytic cells 1 may be connected to one and the same decontamination system 7. For clarity reasons is only one electrolytic cell 1 shown in FIG. 1.

The method comprises sucking acid mist from the space 9 between the surface 10 of the electrolyte 6 contained in the container 2 and the cover 3 by means of the suction means 11 of the decontamination system 7.

The method comprises providing a cleaning arrangement 14 for spraying the upwards facing inlet opening 13 of the acid mist suction channel 8 with washing fluid 15 to prevent the upwards facing inlet opening 13 of the acid mist suction channel 8 from being blocked.

The method comprises spraying the upwards facing inlet opening 13 of the acid mist suction channel 8 with washing fluid 15 by means of the cleaning arrangement 14 to prevent the upwards facing inlet opening 13 of the acid mist suction channel 8 from being blocked.

The method comprises providing a cleaning arrangement 14 having a fluid nozzle 16 and a pipe 17 for feeding washing fluid 15 to the fluid nozzle 16.

The method comprises arranging the pipe 17 and the fluid nozzle 16 so that the pipe 17 is at least partly located in the acid mist suction channel 8 and so that the fluid nozzle 16 is located at the upwards facing inlet opening 13 of the acid mist suction channel 8.

The method comprises spraying washing fluid 15 at least downwards into the acid mist suction channel 8 by means of the fluid nozzle 16 of the cleaning arrangement 14. The definition "to spray washing fluid 15 downwards" does not necessarily mean "to spray washing fluid 15 in a direction vertically downwards", but includes also "to spray washing fluid 15 in an inclined direction downwards". It is possible that in addition to spraying washing fluid 15 downwards into the acid mist suction channel 8 by means of the fluid nozzle 16, washing fluid 15 is additionally sprayed vertically and/or upwards into the acid mist suction channel 8 by means of the fluid nozzle 16.

The method may include arranging the fluid nozzle 16 in the middle of the acid mist suction channel 8 and by spraying washing fluid 15 360 degrees around the fluid nozzle 16.

The method may include providing a fluid nozzle 16 that has a spring loaded cap 18 that protects the fluid nozzle 16 when the fluid nozzle 16 is inactive and that is adapted to open for allowing washing fluid 15 to be sprayed from the fluid nozzle 16 when washing fluid 15 is sprayed by means of the fluid nozzle 16.

The method may include spraying washing fluid 15 at least downwards into the acid mist suction channel 8 by means of the fluid nozzle 16 of the cleaning arrangement 14 in predetermined time intervals and/or when needed.

Washing fluid 15 containing water, preferably washing fluid 15 being water, may be used in the method.

The method may include providing a decontamination system 7 having an acid mist suction channel 8 having a vertical channel section 19 terminating at the upwards facing inlet opening 13.

The method may include arranging the pipe 17 of the cleaning arrangement 14 to penetrate a wall structure 20 of the acid mist suction channel 8 of the decontamination system 7 at an opening 21 located a level below the fluid nozzle 16 to that the pipe 17 of the cleaning arrangement 14 have pipe 17 section located in the acid mist suction channel 8 of the decontamination system 7 between the opening 21 and the fluid nozzle 16.

In the method, the container 2 of the electrolytic cell 1 may have an upper peripheral surface 22 surrounding the open top of the container 2, and the upwards facing inlet opening 13 of the acid mist suction channel 8 may be arranged vertically at the level of the upper peripheral surface 22 surrounding the open top of the container 2.

The method may include providing an acid mist removal box 23 at the outer surface of the container 2 so that the acid mist removal box 23 having an upper surface located vertically at an upper peripheral surface 22 surrounding the open top of the container 2, providing the acid mist removal box 23 with a channel forming a part of the acid mist suction channel 8 of the decontamination system 7, wherein the channel in the acid mist removal box 23 having an opening at the upper surface forming the upwards facing inlet opening 13 of the acid mist suction channel 8 of the decontamination system 7, and covering the open top of the container 2 so that the cover 3 covers at least the opening of the acid mist removal box 23. The acid mist removal box 23 may be provided as an integral part of the container 2 or as a part that is fastened to the container 2.

Next the arrangement and some preferred embodiments and variants of the arrangement will be described in greater detail.

The arrangement comprises a cover 3 for covering the open top of the container 2 so that a space 9 is formed between a surface 10 of the electrolyte 6 contained in the container 2 and the cover 3.

The arrangement comprises a decontamination system 7 provided with an acid mist suction channel 8 terminating in an upwards facing inlet opening 13 in the space 9 between the surface 10 of the electrolyte 6 contained in the container 2 and the cover 3, and provided with suction means 11 for sucking acid mist from the space 9 between the surface 10 of the electrolyte 6 contained in the container 2 and the cover 3. The decontamination system 7 may have a scrubber 12 for scrubbing acid mist originating from at least one electrolytic cell 1. Several electrolytic cells 1 may be connected to one and the same decontamination system 7. For clarity reasons is only one electrolytic cell 1 shown in FIG. 1.

The arrangement comprises a cleaning arrangement 14 for spraying the upwards facing inlet opening 13 of the acid mist suction channel 8 with washing fluid 15 to prevent the upwards facing inlet opening 13 of the acid mist suction channel 8 from being blocked.

The cleaning arrangement 14 has a fluid nozzle 16 and a pipe 17 for feeding washing fluid 15 to the fluid nozzle 16.

The pipe 17 and the fluid nozzle 16 are arranged so that the pipe 17 is at least partly located in the acid mist suction channel 8 and so that the fluid nozzle 16 is located at the upwards facing inlet opening 13 of the acid mist suction channel 8.

The fluid nozzle 16 of the cleaning arrangement 14 are arranged to spray washing fluid 15 at least downwards into the acid mist suction channel 8. The definition "to spray washing fluid 15 downwards" does not necessarily mean "to spray washing fluid 15 in a direction vertically downwards", but includes also "to spray washing fluid 15 in an inclined direction downwards". It is possible that the fluid nozzle 16 of the cleaning arrangement 14 in addition to being arranged to spray washing fluid 15 downwards into the acid mist suction channel 8, is additionally arranged to spray washing fluid 15 vertically and/or upwards into the acid mist suction channel 8.

The fluid nozzle 16 may be arranged in the middle of the acid mist suction channel 8, and the fluid nozzle 16 may be arranged to spray washing fluid 15 360 degrees around the fluid nozzle 16.

The fluid nozzle 16 may have a spring loaded cap 18 that protects the fluid nozzle 16 when the fluid nozzle 16 is inactive and that is adapted to open for allowing washing fluid 15 to be sprayed from the fluid nozzle 16 when washing fluid 15 is sprayed by means of the fluid nozzle 16.

The cleaning arrangement 14 may be configured for spraying washing fluid 15 at least downwards into the acid mist suction channel 8 by means of the fluid nozzle 16 of the cleaning arrangement 14 in predetermined time intervals and/or when needed.

The washing fluid 15 may contain water, or preferably contain solely water.

The acid mist suction channel 8 of the decontamination system 7 may have a vertical channel section 19 terminating at the upwards facing inlet opening 13.

The pipe 17 of the cleaning arrangement 14 may penetrate a wall structure 20 of the acid mist suction channel 8 of the decontamination system 7 at an opening 21 located a level below the fluid nozzle 16 so that the pipe 17 of the cleaning arrangement 14 have pipe 17 section located in the acid mist suction channel 8 of the decontamination system 7 between the opening and the fluid nozzle 16.

The container 2 may have an upper peripheral surface 22 surrounding the open top of the container 2, and the upwards facing inlet opening 13 of the acid mist suction channel 8 may be arranging vertically at the level of the upper peripheral surface 22 surrounding the open top of the container 2.

The arrangement may comprise an acid mist removal box 23 provided at the outer surface of the container 2 so that the acid mist removal box 23 have an upper surface located vertically at an upper peripheral surface 22 surrounding the open top of the container 2, and so that the acid mist removal box 23 have a channel forming a part of the acid mist suction channel 8 of the decontamination system 7, wherein the channel in the acid mist removal box 23 having an opening at the upper surface forming the upwards facing inlet opening 13 of the acid mist suction channel 8 of the decontamination system 7, and so that the cover 3 for covering the open top of the container 2 covering at least the opening of the acid mist removal box 23. The acid mist removal box 23 may be an integral part of the container 2 or a part that is fastened to the container 2.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A method for collecting and removal of acid mist from an electrolytic cell in a metal electrowinning process or in a metal electrorefining process, where an electric current is passed between a plurality of electrodes, from anodes to cathodes alternately arranged and submerged in electrolyte contained in a container having an open top, the method comprising:

covering the open top of the container with a cover so that a space is formed between a surface of the electrolyte contained in the container and the cover, providing a decontamination system having an acid mist suction channel terminating in an upwards facing inlet opening in the space between the surface of the electrolyte contained in the container and the cover, and having suction means for sucking acid mist from the space between the surface of the electrolyte contained in the container and the cover, sucking acid mist from the space between the surface of the electrolyte contained in the container and the cover by means of the suction means of the decontamination system, providing a cleaning arrangement for spraying the upwards facing inlet opening of the acid mist suction channel with washing fluid to prevent the upwards facing inlet opening of the acid mist suction channel from being blocked, and spraying the upwards facing inlet opening of the acid mist suction channel with washing fluid by means of the cleaning arrangement to prevent the upwards facing inlet opening of the acid mist suction channel from being blocked, providing a cleaning arrangement having a fluid nozzle and a pipe for feeding washing fluid to the fluid nozzle, arranging the pipe and the fluid nozzle so that the pipe is at least partly located in the acid mist suction channel and so that the fluid nozzle is located at the upwards facing inlet opening of the acid mist suction channel, and spraying washing fluid at least downwards into the acid mist suction channel by means of the fluid nozzle of the cleaning arrangement.

2. The method according to claim 1, further comprising arranging the fluid nozzle in the middle of the acid mist suction channel and by spraying washing fluid 360 degrees around the fluid nozzle.

3. The method according to claim 1, further comprising providing a fluid nozzle that has a spring loaded cap that protects the fluid nozzle when the fluid nozzle is inactive and that is adapted to open for allowing washing fluid to be sprayed from the fluid nozzle when washing fluid is sprayed by means of the fluid nozzle.

4. The method according to claim 1, further comprising spraying washing fluid at least downwards into the acid mist suction channel by means of the fluid nozzle of the cleaning arrangement in predetermined time intervals and/or when needed.

5. The method according to claim 1, further comprising using washing fluid containing water.

6. The method according to claim 1, wherein the acid mist suction channel of the decontamination system has a vertical channel section terminating at the upwards facing inlet opening.

7. The method according to claim 1, further comprising:

arranging the pipe of the cleaning arrangement to penetrate a wall structure of the acid mist suction channel of the decontamination system at an opening located at a level below the fluid nozzle so that the pipe of the cleaning arrangement has a pipe section located in the acid mist suction channel of the decontamination system between the opening and the fluid nozzle.

8. The method according to claim 1, wherein the container is provided with an upper peripheral surface surrounding the open top of the container, and the upwards facing inlet opening of the acid mist suction channel is arranged vertically at the level of the upper peripheral surface surrounding the open top of the container.

9. The method according to claim 1, further comprising:

providing an acid mist removal box at the outer surface of the container so that the acid mist removal box has an upper surface located vertically at an upper peripheral surface surrounding the open top of the container, providing the acid mist removal box with a channel forming a part of the acid mist suction channel of the decontamination system, wherein the channel in the acid mist removal box has an opening at the upper surface forming the upwards facing inlet opening of the acid mist suction channel of the decontamination system, and covering the open top of the container so that the cover covers at least the opening of the acid mist removal box.

10. An arrangement for collecting and removal of acid mist from an electrolytic cell in a metal electrowinning process or in a metal electrorefining process, where an electric current is passed between a plurality of electrodes, from anodes to cathodes alternately arranged and submerged in electrolyte contained in a container having an open top, wherein the arrangement comprising:

a cover for covering the open top of the container so that a space is formed between a surface of the electrolyte contained in the container and the cover, a decontamination system provided with an acid mist suction channel terminating in an upwards facing inlet opening in the space between the surface of the electrolyte contained in the container and the cover, and provided with suction means for sucking acid mist from the space between the surface of the electrolyte contained in the container and the cover, and a cleaning arrangement for spraying the upwards facing inlet opening of the acid mist suction channel with washing fluid to prevent the upwards facing inlet opening of the acid mist suction channel from being blocked, wherein the cleaning arrangement has a fluid nozzle and a pipe for leading washing fluid to the fluid nozzle, the pipe and the fluid nozzle is arranged so that the pipe is at least partly located in the acid mist suction channel and so that the fluid nozzle is located at the upwards facing inlet opening of the acid mist suction channel, and the fluid nozzle of the cleaning arrangement is arranged to spray washing fluid at least downwards into the acid mist suction channel.

11. The arrangement according to claim 10, wherein:

the fluid nozzle is arranged in the middle of the acid mist suction channel, and the fluid nozzle is arranged to spray washing fluid 360 degrees around the fluid nozzle.

12. The arrangement according to claim 10 wherein:

the fluid nozzle has a spring loaded cap that protects the fluid nozzle when the fluid nozzle is inactive and that is adapted to open for allowing washing fluid to be sprayed from the fluid nozzle when washing fluid is sprayed by means of the fluid nozzle.

13. The arrangement according to claim 10, wherein: the cleaning arrangement is configured for spraying washing fluid at least downwards into the acid mist suction channel by means of the fluid nozzle of the cleaning arrangement in predetermined time intervals and/or when needed.

14. The arrangement according to claim 10, wherein the washing fluid comprises water.

15. The arrangement according to claim 10, wherein: the acid mist suction channel of the decontamination system has a vertical channel section terminating at the upwards facing inlet opening.

16. The arrangement according to claim 10, wherein:

the pipe of the cleaning arrangement is arranged to penetrate a wall structure of the acid mist suction channel of the decontamination system at an opening located at a level below the fluid nozzle, and the pipe of the cleaning arrangement has a pipe section located in the acid mist suction channel of the decontamination system between the opening and the fluid nozzle.

17. The arrangement according to claim 10, wherein:

the container has an upper peripheral surface surrounding the open top of the container, and the upwards facing inlet opening of the acid mist suction channel is arranged vertically at the level of the upper peripheral surface surrounding the open top of the container.

18. The arrangement according to claim 10, wherein:

an acid mist removal box is provided at the outer surface of the container, the acid mist removal box has an upper surface located vertically at an upper peripheral surface surrounding the open top of the container, the acid mist removal box has a channel forming a part of the acid mist suction channel of the decontamination system, wherein the channel in the acid mist removal box has an opening at the upper surface forming the upwards facing inlet opening of the acid mist suction channel of the decontamination system, and the cover for covering the open top of the container covers at least the opening of the acid mist removal box.

* * * * *